US010400668B2

(12) United States Patent
Hiyoshi et al.

(10) Patent No.: US 10,400,668 B2
(45) Date of Patent: Sep. 3, 2019

(54) ACTUATOR DEVICE FOR VARIABLE COMPRESSION RATIO INTERNAL COMBUSTION ENGINE

(71) Applicants: NISSAN MOTOR CO., LTD., Yokohama-shi, Kanagawa (JP); HITACHI AUTOMOTIVE SYSTEMS, LTD., Hitachinaka-shi, Ibaraki (JP)

(72) Inventors: Ryosuke Hiyoshi, Kanagawa (JP); Yoshiaki Tanaka, Kanagawa (JP); Kishiro Nagai, Atsugi (JP); Junichiro Onigata, Atsugi (JP); Yoshihiko Yamada, Fujisawa (JP)

(73) Assignees: NISSAN MOTOR CO., LTD., Yokohama-shi (JP); HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 0 days.

(21) Appl. No.: 15/770,677

(22) PCT Filed: Sep. 27, 2016

(86) PCT No.: PCT/JP2016/078443
§ 371 (c)(1),
(2) Date: Apr. 24, 2018

(87) PCT Pub. No.: WO2017/073225
PCT Pub. Date: May 4, 2017

(65) Prior Publication Data

US 2018/0320587 A1 Nov. 8, 2018

(30) Foreign Application Priority Data

Oct. 30, 2015 (JP) ..... 2015-213584

(51) Int. Cl.
*F02B 75/04* (2006.01)
*F02B 75/32* (2006.01)
*F01M 11/03* (2006.01)

(52) U.S. Cl.
CPC ..... *F02B 75/045* (2013.01); *F01M 11/03* (2013.01); *F02B 75/04* (2013.01); *F02B 75/32* (2013.01)

(58) Field of Classification Search
CPC ..... F01M 11/03; F02B 75/045; F02B 75/04; F02B 75/32
See application file for complete search history.

(56) References Cited

U.S. PATENT DOCUMENTS 8,726,858 B2 * 5/2014 Hiyoshi ..... F02B 75/04 123/48 R
9,422,872 B2 * 8/2016 Hiyoshi ..... F02B 75/32
(Continued)

FOREIGN PATENT DOCUMENTS

JP 2014-159770 A 9/2014
WO WO 2013/080673 A1 6/2013
WO WO 2014-129088 A1 8/2014

*Primary Examiner* — Kevin A Lathers
(74) *Attorney, Agent, or Firm* — Foley & Lardner LLP

(57) ABSTRACT

The control shaft (20) of a variable compression ratio mechanism is coordinated with the auxiliary shaft (25) of an actuator device (1) through an intermediate link (31). The housing (5) of the actuator device (1) has on the lower surface thereof an oil filter mounting seat section (36), and a stopper section (37) is formed integrally with the oil filter mounting seat section (36). A second arm (28) of the auxiliary shaft (25) comes in contact with the stopper section (37) to define the limit of the compression ratio on the low compression ratio side. The stopper section (37) has high rigidity because the oil filter mounting seat section (36) having high rigidity and the stopper section (37) are integrated together.

8 Claims, 6 Drawing Sheets

(56) References Cited

U.S. PATENT DOCUMENTS

| | | | | |
|---|---|---|---|---|
| 10,001,056 | B2 * | 6/2018 | Hiyoshi | ..... F02B 75/047 |
| 2015/0377120 | A1 | 12/2015 | Hiyoshi | |

* cited by examiner

ACTUATOR DEVICE FOR VARIABLE COMPRESSION RATIO INTERNAL COMBUSTION ENGINE

TECHNICAL FIELD

The present invention relates to a variable compression ratio internal combustion engine including a variable compression ratio mechanism, wherein the variable compression ratio mechanism includes a control shaft, and an actuator configured to rotate the control shaft, and is configured to vary a mechanical compression ratio depending on rotational position of the control shaft, and relates particularly to an actuator apparatus including the actuator.

BACKGROUND ART

Conventionally, various types of variable compression ratio mechanism are known for varying a mechanical compression ratio of an internal combustion engine. For example, the present applicant and others have proposed many variable compression ratio mechanisms, each of which is configured to vary a piston top dead center position vertically by varying a link geometry of a multi-link type piston-crank mechanism. Moreover, variable compression ratio mechanisms are publicly known each of which is configured to vary a mechanical compression ratio similarly, by varying a cylinder position vertically with respect to a central position of a crankshaft.

A patent document 1 discloses an actuator apparatus for such a variable compression ratio mechanism, in which an actuator and an auxiliary shaft are provided in a housing mounted to a side wall of an engine body, and the auxiliary shaft and a control shaft inside the engine body are linked via a link mechanism. Specifically, the auxiliary shaft is configured to be rotated via a speed reduction mechanism by an actuator such as an electric motor within a predetermined angle range, to determine rotational position of the control shaft.

The housing described above is formed substantially integrally with a mount part for an oil filter in a lubricating oil system of an internal combustion engine. Specifically, the housing is employed and configured for mounting a cartridge type oil filter, because the housing projects outwardly from the side wall of the engine body.

The configuration that the oil filter mount part is formed integrally with the housing of the actuator apparatus, leads to an increase of thickness of the housing and thereby an increase of weight of the housing, for ensuring rigidity of the oil filter mount part. Furthermore, a variable compression ratio mechanism as described above is provided with a stopper part configured to be in mechanical contact with a part of the auxiliary shaft or link, and thereby define a bound of mechanical compression ratio for a lower compression ratio side or a higher compression ratio side. If this stopper part is arranged in the actuator apparatus, it may be also a factor for increasing the weight of the housing.

Since the housing is mounted to the side wall of the engine body to project outwardly, increase of the weight of the housing may adversely affect vibration and noise of the internal combustion engine, and is therefore undesirable.

PRIOR ART DOCUMENT(S)

Patent Document(s)

Patent Document 1: International Publication No. 2013/080673

SUMMARY OF THE INVENTION

According to the present invention, a variable compression ratio mechanism actuator apparatus for an internal combustion engine including a variable compression ratio mechanism, wherein the variable compression ratio mechanism includes a control shaft, and an actuator configured to rotate the control shaft, and is configured to vary a mechanical compression ratio depending on rotational position of the control shaft, the variable compression ratio mechanism actuator apparatus comprises: a housing attached to a side wall of an engine body, and configured to support the actuator and accommodate an auxiliary shaft whose rotational position is configured to be controlled by the actuator; a link mechanism configured to link the control shaft with the auxiliary shaft, wherein the control shaft is disposed inside of the engine body; an oil filter mount part formed as a part of the housing; and a stopper part formed integrally with the oil filter mount part, and configured to define a first bound of rotational position of the auxiliary shaft.

Namely, the oil filter mount part is formed in part of the housing that supports the actuator implemented by an electric motor or the like, and the stopper part is formed integrally with the oil filter mount part. Contact of the stopper part with part of the control shaft, link mechanism, or the like defines the first bound of rotational position of the auxiliary shaft, and thereby defines a bound of mechanical compression ratio.

According to the present invention, the feature that the oil filter mount part and the stopper part, which are required to have high rigidity, are formed integrally with the housing, makes it easy to ensure high rigidity of the stopper part, and makes it possible to minimally suppress the weight of the housing from being increased by formation of the oil filter mount part and the stopper part.

MODE(S) FOR CARRYING OUT THE INVENTION

The following describes an embodiment of the present invention in detail with reference to the drawings.

Figure 1:
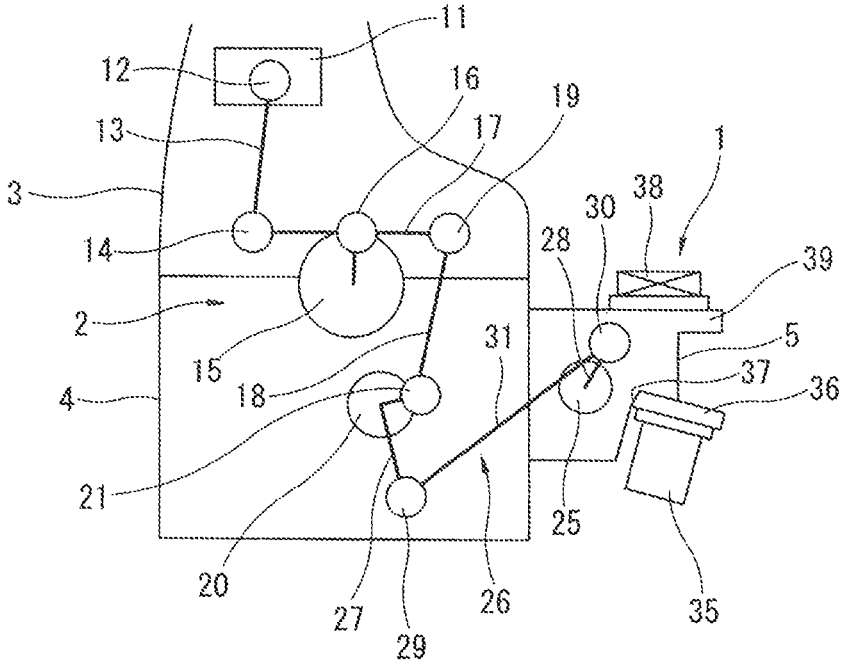
FIG. 1 is an illustrative diagram showing schematically an actuator apparatus according to an embodiment, with a multi-link type piston-crank mechanism as a variable compression ratio mechanism.

FIG. 1 is an illustrative diagram showing schematically an actuator apparatus 1 according to the embodiment, with a multi-link type piston-crank mechanism 2 as a variable compression ratio mechanism. Multi-link type piston-crank mechanism 2 is accommodated in an engine body that includes a cylinder block 3 and an oil pan upper 4, whereas actuator apparatus 1 includes a housing 5 that is attached to an outside surface of a side wall of oil pan upper 4 forming a part of the engine body and projects outwardly from the engine body.

Multi-link type piston-crank mechanism 2 is configured as publicly known by patent document 1 and others, including: an upper link 13 including a first end linked with a piston 11 via a piston pin 12; a lower link 17 including a first end linked with a second end of upper link 13 via an upper pin 14, and an intermediate portion liked with a crank pin 16 of a crankshaft 15; and a control link 18 configured to restrict a degree of freedom of lower link 17. Control link 18 includes a distal end linked with a second end of lower link 17 via a control pin 19, and a proximal end supported by an eccentric shaft part 21 of a control shaft 20 for swinging motion. In the thus-configured multi-link type piston-crank mechanism 2, the top dead center position of piston 11 varies depending on rotational position of control shaft 20, to vary a mechanical compression ratio of the engine. In other words, the mechanical compression ratio is determined uniquely with respect to the rotational position of control shaft 20.

On the other hand, actuator apparatus 1 includes an auxiliary shaft 25 whose rotational position is controlled via a speed reducer by an actuator implemented by an electric motor as described below, and which is linked with control shaft 20 via an actuator-use link mechanism 26. Actuator-use link mechanism 26 includes: a first arm 27 attached to control shaft 20; a second arm 28 attached to auxiliary shaft 25; an intermediate link 31 including a first end linked with first arm 27 via a first link pin 29, and a second end linked with second arm 28 via a second link pin 30, linking the first arm 27 and second arm 28 with each other. Namely, actuator-use link mechanism 26 has a so-called four node link structure, which links rotation of auxiliary shaft 25 with rotation of control shaft 20. In this configuration, first link pin 29 is positioned generally below control shaft 20, and second link pin 30 is positioned generally above auxiliary shaft 25, and both are liked by intermediate link 31 with each other. This allows auxiliary shaft 25 and control shaft 20 to rotate in opposite directions. For example, in FIG. 1, rotation of auxiliary shaft 25 in the counterclockwise direction from the state shown in FIG. 1 causes control shaft 20 to rotate in the clockwise direction.

As detailed below, housing 5 of actuator apparatus 1 includes an oil filter mount part 36 to which an oil filter 35 of cartridge type is detachably attached, wherein oil filter 35 is cylindrically shaped or cup-shaped. Oil filter mount part 36 is a relatively thick part, and is formed integrally with a stopper part 37 that is configured to be in contact with second arm 28 in its predetermined rotational position. As clearly shown in FIG. 1 about linkage configuration of multi-link type piston-crank mechanism 2, stopper part 37 according to the present embodiment defines a bound of lower compression ratio side of the variable compression ratio mechanism. A second stopper part not shown is provided in the engine body, to define a bound of higher compression ratio side, for example, by contact with first arm 27. Housing 5 includes an upper surface formed with an oil cooler mount part 39 to which an oil cooler 38 of multiplate type is fixedly mounted, wherein oil cooler 38 exchanges heat between lubricating oil and engine coolant water.

The following describes specific configuration of actuator apparatus 1 with reference to FIGS. 2 to 6.

Figure 3:
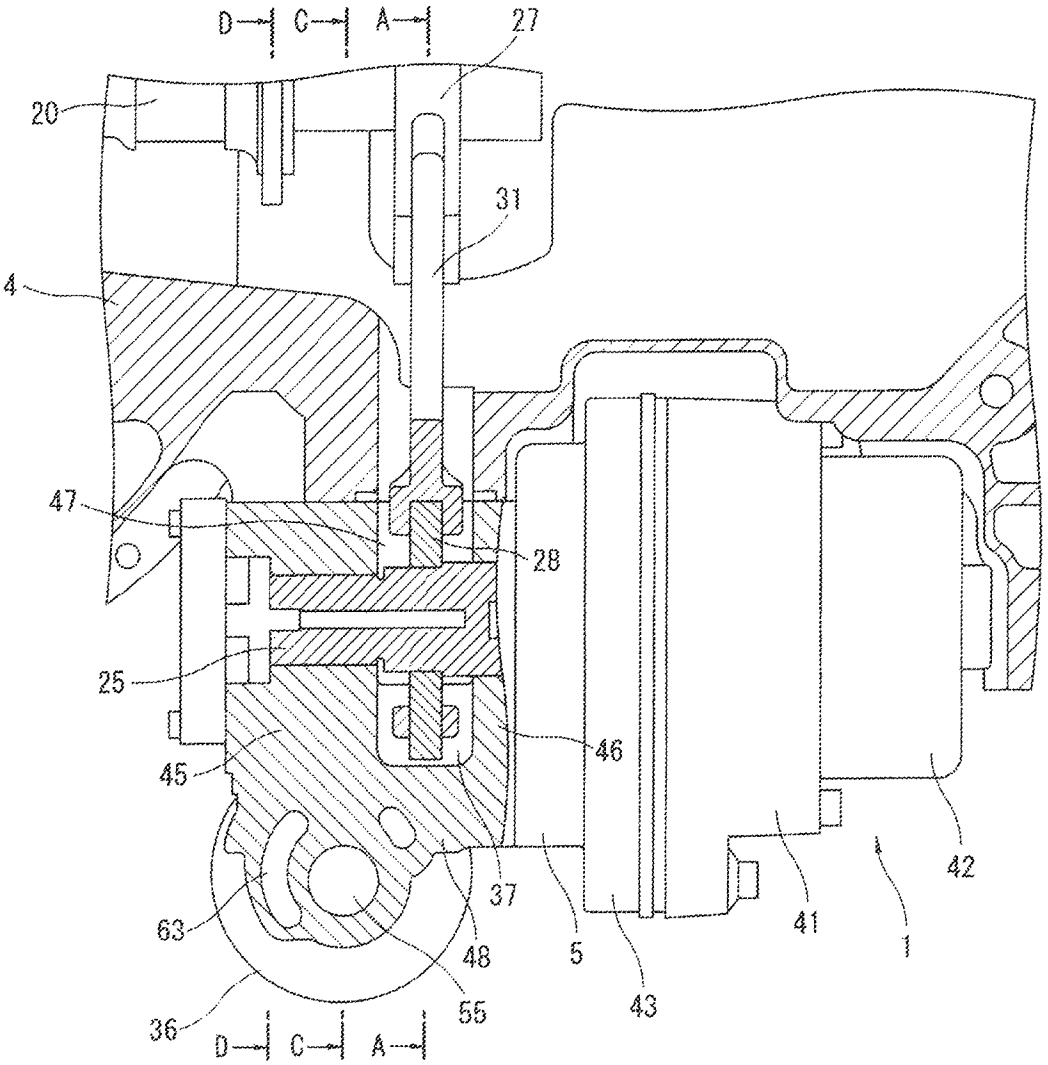
FIG. 3 is a sectional view of the actuator apparatus taken along a line B-B in FIG. 2.
Figure 6:
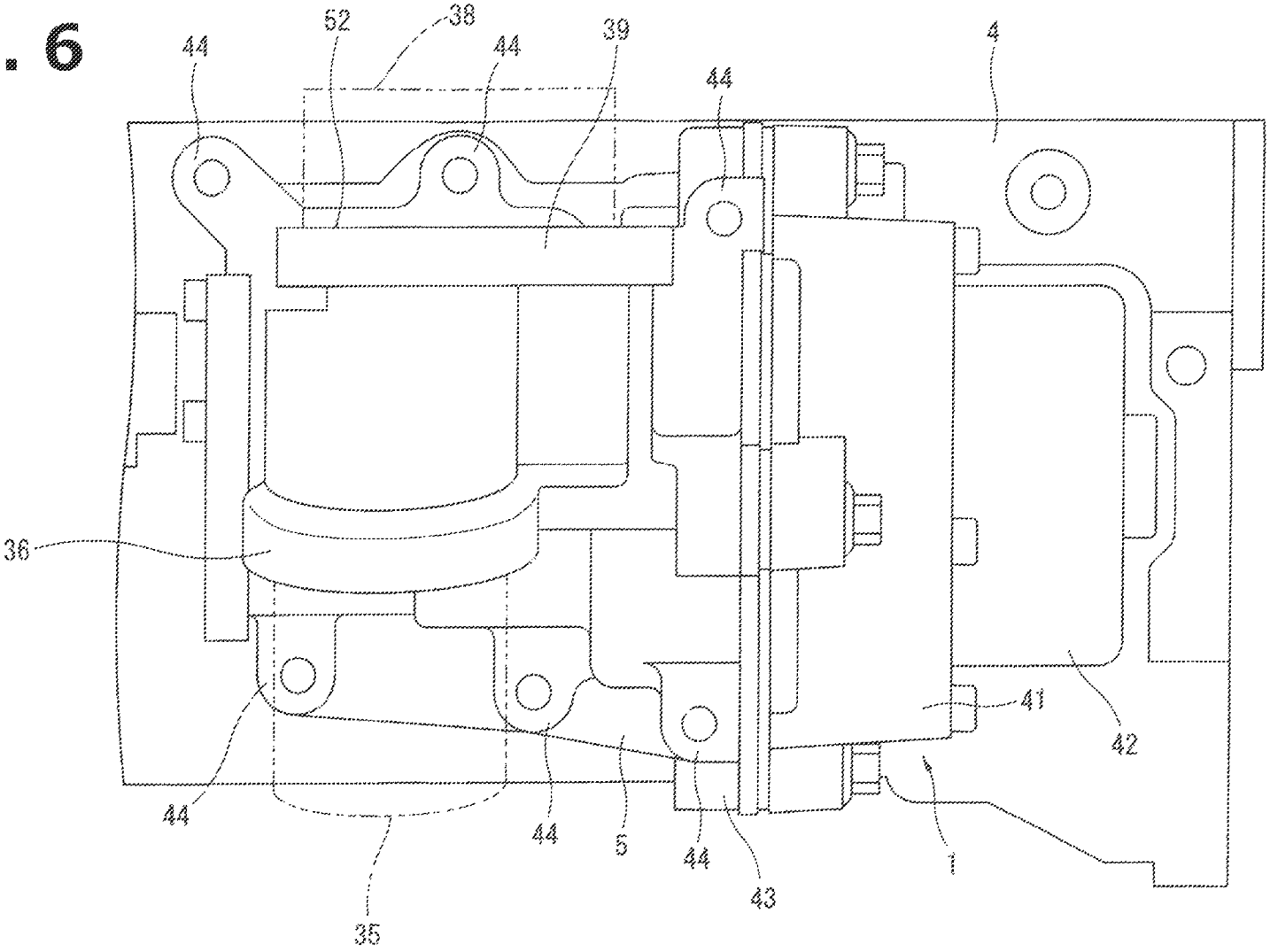
FIG. 6 is a side view of the actuator apparatus.

As shown in FIGS. 3 and 6, actuator apparatus 1 generally includes: housing 5 made of metal, such as an aluminum alloy cast, accommodating the auxiliary shaft 25; a speed reducer 41 attached to a first axial end portion of housing 5, and having a disc-like shape; and an electric motor 42 layered on and attached to an end portion of speed reducer 41, and having a disc-like shape, and serving as an actuator. Electric motor 42 includes a cup-shaped case, which is supported by housing 5 via speed reducer 41 (specifically, a cylindrical case of speed reducer 41). For convenience of description, a side where electric motor 42 is arranged is henceforth referred to as "rear" side of actuator apparatus 1, and a side opposite to electric motor 42 is henceforth referred to as "front" side of actuator apparatus 1.

Although internal configuration of electric motor 42 and speed reducer 41 is not shown because it is no major part of the present invention, a central rotational axis of electric motor 42 and auxiliary shaft 25 are coaxially arranged, namely, arranged in series, wherein speed reducer 41 is disposed between electric motor 42 and auxiliary shaft 25, and includes a speed reduction mechanism having a large reduction ratio, such as a publicly known harmonic drive mechanism. Accordingly, rotation of electric motor 42 is transmitted after speed reduction and converted into a suitable angle of rotation of auxiliary shaft 25, wherein a large torque is obtained to drive the auxiliary shaft 25 in rotational direction. Auxiliary shaft 25 includes a rear end portion directly coupled to an output-side member of the speed reduction mechanism. Accordingly, auxiliary shaft 25 may be regarded as an output shaft of speed reducer 41.

Housing 5 includes a cylindrical part 43 at its rear end portion, where speed reducer 41 is attached to cylindrical part 43. As shown in FIG. 6, housing 5 includes bolt boss parts 44 in its periphery, wherein each bolt boss part 44 serves to fix the housing 5 to oil pan upper 4 by a bolt not shown. As shown in FIG. 3, a part of housing 5 on the front side of cylindrical part 43 includes a first wall part 45 and a second wall part 46, wherein first wall part 45 and second wall part 46 are relatively thick and substantially parallel to a plane perpendicular to the axial direction of auxiliary shaft 25, wherein a space 47 having a substantially constant width is defined between first wall part 45 and second wall part 46, and wherein second arm 28 and the end portion of intermediate link 31 swing in space 47. Auxiliary shaft 25 is rotatably supported in a bearing hole of first wall part 45 and a bearing hole of second wall part 46, namely, is supported at two places on the front side and on the rear side of second arm 28. First wall part 45 and second wall part 46 are connected to each other by an outside wall part 48 that are relatively thick and extends in the fore-and-aft direction along the outside of housing 5, wherein the outside of space 47 is closed by outside wall part 48. Outside wall part 48 is continuous with cylindrical part 43 at the rear end of housing 5 as shown in FIG. 3, and extends vertically in parallel to a side wall surface of oil pan upper 4 (namely, a surface of oil pan upper 4 to which housing 5 is attached) as shown in FIG. 2.

Figure 4:
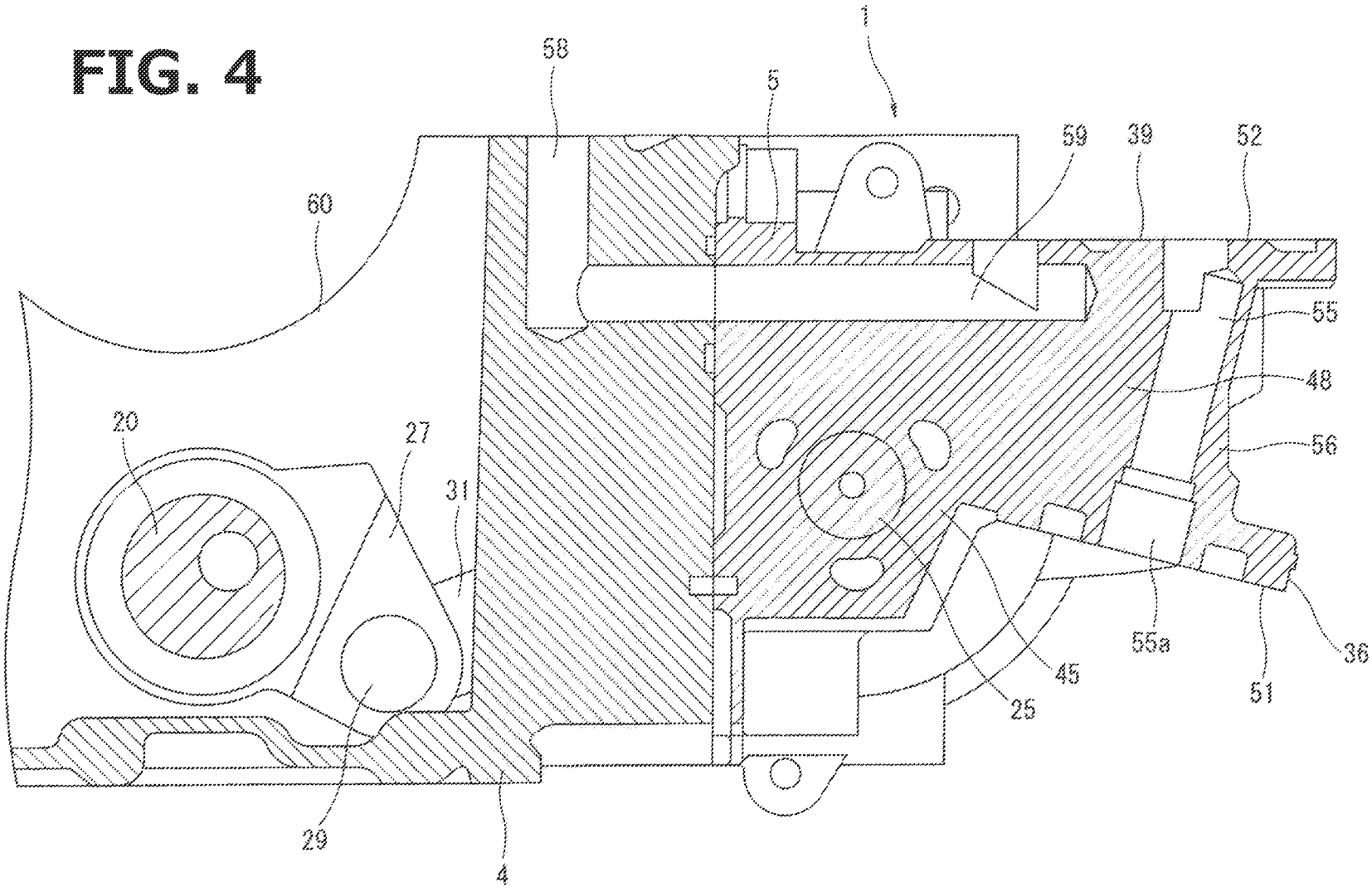
FIG. 4 is a sectional view of the actuator apparatus and the major part of the engine body, taken along a line C-C in FIG. 3.

As shown in FIGS. 3 and 6, oil filter mount part 36 is formed to have a disc-like shape in an underside of a front-side portion of housing 5 where first wall part 45 is connected to outside wall part 48. Specifically, oil filter mount part 36 is continuous integrally with an outside portion of first wall part 45 (a portion projecting outwardly with respect to auxiliary shaft 25) as shown in FIGS. 3 and 4, and is continuous with a lower end of outside wall part 48 as shown in FIG. 2. Most part of oil filter mount part 36 except for part overlapping with first wall part 45 and outside wall part 48, projects in a circular shape outwardly from outside wall part 48. As shown in FIG. 2, oil filter mount part 36 includes a filter mount surface 51 at its underside, wherein oil filter 35 of cartridge type is mounted to filter mount surface 51. Oil filter mount part 36 and filter mount surface 51 are slightly inclined (for example, by an angle of several degrees) inwardly to a plane perpendicular to the side wall surface of oil pan upper 4 (the surface to which housing 5 is mounted), namely, slightly inclined in such a direction that a lower end of the mounted oil filter 35 gets closer to the engine body.

Figure 2:
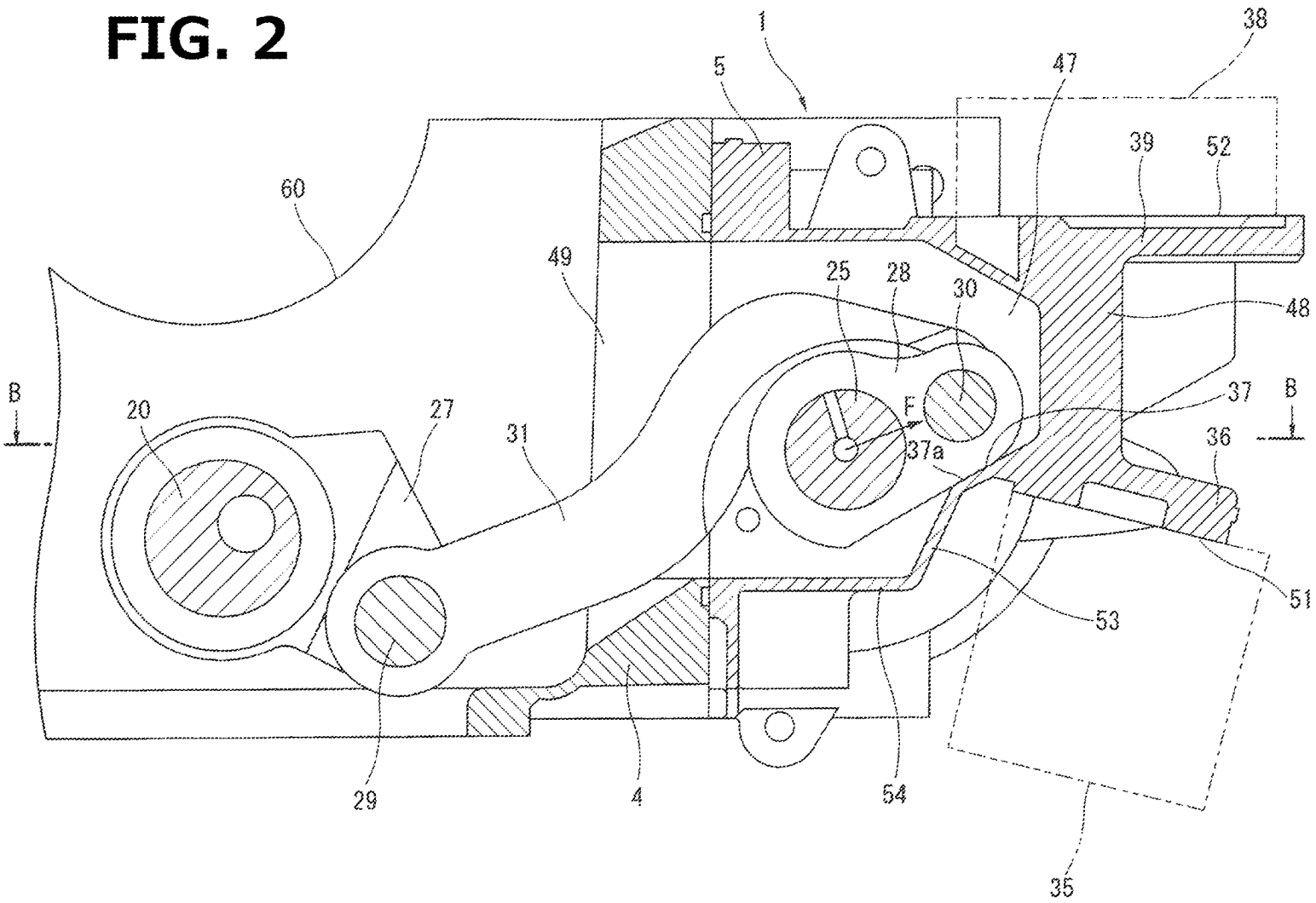
FIG. 2 is a sectional view of the actuator apparatus and a major part of an engine body, taken along a line A-A in FIG. 3.

As clearly shown in FIG. 2, the point of connection between second arm 28 and intermediate link 31, namely, the central point of second link pin 30, moves above the height position of the center of rotation of auxiliary shaft 25. Namely, the locus of the central point of second link pin 30 is above the height position of the center of rotation of auxiliary shaft 25. On the other hand, the filter mount surface 51 of oil filter mount part 36 is positioned below the height position of the center of rotation of auxiliary shaft 25, as shown in FIGS. 2 and 4.

As shown in FIG. 2, stopper part 37 is formed integrally with an inside portion of oil filter mount part 36 (a portion closer to the engine body). As shown in FIG. 2, stopper part 37 is in the form of a wall extending diagonally from the lower end of outside wall part 48 toward the inside of space 47, and is continuous with an inclined wall 53 and a bottom wall 54 covering the lower part of space 47. FIG. 2 shows a state where second arm 28 is in contact with stopper part 37, wherein stopper part 37 includes a stopper surface 37*a* in the form of an inclined flat surface, wherein stopper surface 37*a* is configured to be in wide contact with a straight side edge of second arm 28. Stopper part 37 is formed to extend in the fore-and-aft direction crossing in space 47 where second arm 28 swings. Stopper part 37 connects the first wall part 45 and second wall part 46 to each other to form the space 47 (see FIG. 3). As shown in FIG. 2, the side wall of oil pan upper 4 to which housing 5 is mounted is formed with an opening 49 having a slit shape and corresponding to space 47, where intermediate link 31 passes through the opening 49.

Oil cooler mount part 39 is formed in the upper part of housing 5, and has a substantially rectangular plate shape along a plane perpendicular to the side wall surface of oil pan upper 4 (namely, the surface to which housing 5 is mounted). Oil cooler mount part 39 is continuous with upper ends of first wall part 45 and second wall part 46, and has a portion projecting outwardly from outside wall part 48 and covering an upper side of oil filter mount part 36 (see FIGS. 2 and 4). As clearly shown in FIG. 2, stopper part 37 is disposed between oil cooler mount part 39 and oil filter mount part 36 in the vertical direction. Oil cooler mount part 39 includes an oil cooler mount surface 52 at its upper side, wherein oil cooler mount surface 52 is flat, and wherein oil cooler 38 of multiplate type is mounted to oil cooler mount surface 52.

FIG. 4 shows a section passing through a substantially central portion of oil filter mount part 36. As shown in FIG. 4, a filter-cooler connection oil passage 55 is formed to have a straight shape extending vertically from the center of oil filter mount part 36 to oil cooler mount part 39. Filter-cooler connection oil passage 55 is inclined slightly with respect to the side wall surface of oil pan upper 4 (namely, the surface to which housing 5 is mounted), perpendicular to the filter mount surface 51. The lower portion of filter-cooler connection oil passage 55 forms an internal thread part 55*a* to which a thread part of a center pile not shown of oil filter 35 of cartridge type is screwed, wherein the center pipe serves as an oil discharge outlet of oil filter 35. Filter-cooler connection oil passage 55 is formed as a tubular passage projecting outwardly from outside wall part 48 such that a tubular wall part 56 surrounding the periphery of filter-cooler connection oil passage 55 connects oil filter mount part 36 and oil cooler mount part 39 vertically. Lubricating oil of the internal combustion engine is made to pass through oil filter 35 and thereby filtered, and is made to flow into an inlet of oil cooler 38 through the filter-cooler connection oil passage 55. The sectional view of FIG. 4 shows a cooler outlet oil passage 59 in the form of a straight shape extending from oil cooler mount part 39 in the inside of first wall part 45 to an oil passage 58 in oil pan upper 4. Cooler outlet oil passage 59 is connected to an outlet of oil cooler 38, so that lubricating oil after cooling is made to return to the engine body through cooler outlet oil passage 59.

Figure 5:
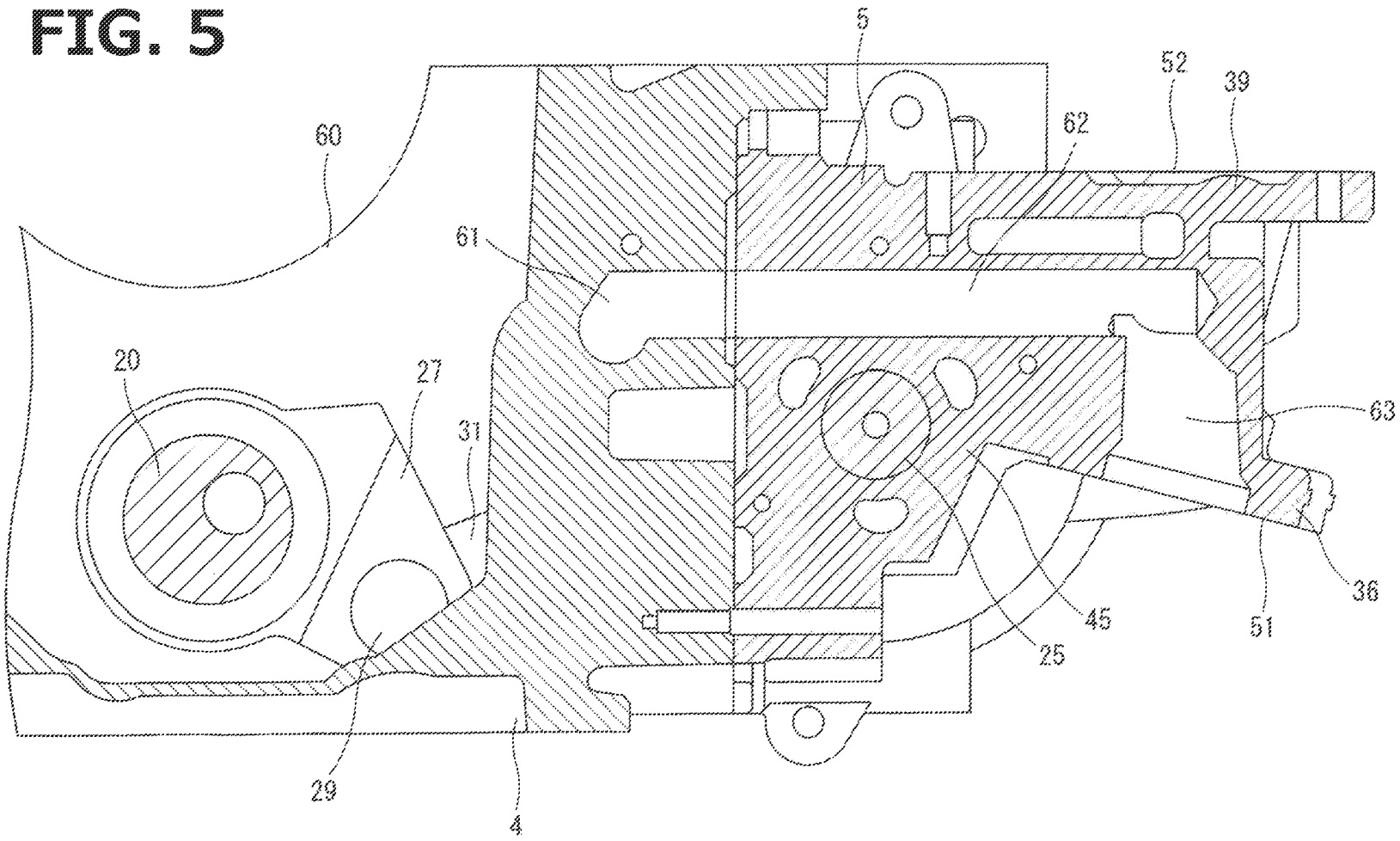
FIG. 5 is a sectional view of the actuator apparatus and the major part of the engine body, taken along a line D-D in FIG. 3.

FIG. 5 is a sectional view slightly ahead of the center of oil filter mount part 36, taken along a line D-D in FIG. 3. As shown in FIG. 5, a filter inlet oil passage 62 is formed inside of first wall part 45 to have a straight shape connected to an oil passage 61 inside of oil pan upper 4. Filter inlet oil passage 62 includes a distal end portion connected to an inlet port passage 63 that has a circular opening (see FIG. 3) at filter mount surface 51. Similar to filter-cooler connection oil passage 55, inlet port passage 63 is formed as a tubular passage extending vertically and projecting outwardly from outside wall part 48.

Accordingly, lubricating oil of the internal combustion engine is made to flow from oil passage 61 in oil pan upper 4 into the inlet side of oil filter 35 through filter inlet oil passage 62 and inlet port passage 63. The lubricating oil after filtering by oil filter 35 is introduced into oil cooler 38 through filter-cooler connection oil passage 55, and then cooled, and made to flow through cooler outlet oil passage 59 into oil passage 58 in oil pan upper 4.

In the actuator apparatus 1 according to the embodiment described above, the configuration that stopper part 37 for defining the bound of lower compression ratio side of the variable compression ratio mechanism is formed integrally with the thick oil filter mount part 36 that has high rigidity by first wall part 45 and outside wall part 48, serves to provide a very high rigidity against contact of second arm 28. In particular, as shown in FIG. 2, the provision of the thick oil filter mount part 36 at the back side of stopper part 37 in the direction of contact, serves to provide a high rigidity without a special reinforcing structure for stopper part 37. The configuration that stopper part 37 connects the first wall part 45 and second wall part 46, serves to further enhance the rigidity of stopper part 37.

In the present embodiment, the configuration that stopper part 37 is disposed between the rigid oil cooler mount part 39 and oil filter mount part 36 in the vertical direction, serves to further enhance the rigidity of stopper part 37.

This serves to suppress the weight of housing 5 from being increased for ensuring the rigidity of stopper part 37.

The present embodiment is configured such that that the locus of the central point of second link pin 30 is above the height position of the center of rotation of auxiliary shaft 25, and the filter mount surface 51 of oil filter mount part 36 is below the height position of the center of rotation of auxiliary shaft 25, as described above. This serves to ensure the space for the locus of rotation of second arm 28 while ensuring the space to which oil filter 35 is mounted and the place in which stopper part 37 is formed, which allows the housing 5 to be made compact and light.

In the present embodiment, the configuration that filter mount surface 51 is inclined inwardly, is advantageous about vibration of oil filter 35 mounted to filter mount surface 51. In the engine body to which actuator apparatus 1 is mounted, a so-called roll vibration occurs mainly in crankshaft 15 supported on a main bearing part 60 (see FIG. 2), and causes an acceleration of oil filter 35 in a direction tangent to rotation. The filter mount surface 51 according to the embodiment is positioned below the center of crankshaft 15, but inclined inwardly so that the angle between filter mount surface 51 and the direction of acceleration (direction of vibration) of oil filter 35 gets close to the right angle as easily understood from FIG. 5 and others. Accordingly, the acceleration is applied to oil filter 35 in a direction close to the axial direction of oil filter 35, so that the surface of oil filter 35 in contact with filter mount surface 51 is prevented from being detached. Furthermore, the configuration that filter mount surface 51 is inclined, serves to shorten the distance between the center of crankshaft 15 and the center of mass of oil filter 35, and thereby suppress vibration of oil filter 35.

A similar roll vibration occurs and causes an acceleration in oil cooler 38 mounted to oil cooler mount part 39. Since oil cooler mount part 39 is in a position generally corresponding to the center of crankshaft 15 in the height direction as shown in FIG. 5 and others, oil cooler mount surface 52 is substantially perpendicular to the direction of acceleration (direction of vibration) of oil cooler 38.

On the other hand, in multi-link type piston-crank mechanism 2 shown in FIG. 1, a load of combustion is applied to piston 11, to cause a load maximally in a direction to lower the compression ratio, so that a load is applied to auxiliary shaft 25 maximally in a direction substantially along the longitudinal direction of intermediate link 31, namely, in the diction generally along an arrow "F" in FIG. 2. With respect to this direction of maximum load, the configuration that housing 5 according to the present embodiment is provided with filter-cooler connection oil passage 55 on the side of outside wall part 48 toward which the load is maximally applied as viewed from the center of auxiliary shaft 25, and tubular wall part 56 forming the filter-cooler connection oil passage 55 serves as a kind of rigidity member to connect oil filter mount part 36 and oil cooler mount part 39 vertically, serves to enhance the rigidity of housing 5 against the maximum load, and suppress the housing 5 from being deformed by the maximum load. This serves to suppress lubrication of the bearing part of auxiliary shaft 25 from being adversely affected by deformation of housing 5, and suppress vibration and noise from being adversely affected by resonance of housing 5.

With regard to acceleration applied to oil filter 35 by the maximum load described above, the feature that filter mount surface 51 is inclined as described above, produces an advantageous effect of suppressing detachment of the mount surface of oil filter 35, because the direction of acceleration gets close to the axial direction of oil filter 35.

The invention claimed is:

1. A variable compression ratio internal combustion engine actuator apparatus for an internal combustion engine including a variable compression ratio mechanism, wherein the variable compression ratio mechanism includes a control shaft, and an actuator configured to rotate the control shaft, and is configured to vary a mechanical compression ratio depending on rotational position of the control shaft, the variable compression ratio internal combustion engine actuator apparatus comprising:

a housing attached to a side wall of an engine body, and configured to support the actuator and accommodate an auxiliary shaft whose rotational position is configured to be controlled by the actuator;

a link mechanism configured to link the control shaft with the auxiliary shaft, wherein the control shaft is disposed inside of the engine body, and wherein the link mechanism includes:

a first arm attached to the control shaft;

a second arm attached to the auxiliary shaft; and an intermediate link configured to link the first arm with the second arm;

an oil filter mount part formed as a part of the housing; and a stopper part formed integrally with the oil filter mount part, and including a stopper surface configured to be in contact with the second arm so as to define a first bound of rotational position of the auxiliary shaft;

wherein the housing includes first and second wall parts perpendicular to the auxiliary shaft, wherein the two wall parts define a space in which the second arm is configured to swing;

wherein the housing includes an outside wall part configured to connect the two wall parts to each other;

wherein the oil filter mount part is continuous with a lower end of the outside wall part; and wherein the stopper part is configured to connect the first wall part to the second wall part.

2. The variable compression ratio internal combustion engine actuator apparatus as claimed in claim 1, wherein:

a locus of a central point of a connecting part between the second arm and the intermediate link is above a height position of a center of rotation of the auxiliary shaft; and the oil filter mount part includes a filter mount surface below the height position.

3. The variable compression ratio internal combustion engine actuator apparatus as claimed in claim 2, wherein the filter mount surface is inclined in a direction toward a condition in which the filter mount surface is perpendicular to a direction of vibration at the oil filter mount part about a center of rotation of a crankshaft.

4. The variable compression ratio internal combustion engine actuator apparatus as claimed in claim 1, wherein the filter mount surface is inclined in a direction toward a condition in which the filter mount surface is perpendicular to a direction of vibration at the oil filter mount part about a center of rotation of a crankshaft.

5. A variable compression ratio internal combustion engine actuator apparatus for an internal combustion engine including a variable compression ratio mechanism, wherein the variable compression ratio mechanism includes a control shaft, and an actuator configured to rotate the control shaft, and is configured to vary a mechanical compression ratio depending on rotational position of the control shaft, the variable compression ratio internal combustion engine actuator apparatus comprising:

a housing attached to a side wall of an engine body, and configured to support the actuator and accommodate an auxiliary shaft whose rotational position is configured to be controlled by the actuator;

a link mechanism configured to link the control shaft with the auxiliary shaft, wherein the control shaft is disposed inside of the engine body;

an oil filter mount part formed as a part of the housing; and a stopper part formed integrally with the oil filter mount part, and configured to define a first bound of rotational position of the auxiliary shaft;

wherein the oil filter mount part is formed to project outwardly from a lower part of an outside wall part of the housing; and wherein the stopper part is formed integrally with an inside part of the oil filter mount part so as to form a wall shape extending inwardly from the outside wall part.

6. The variable compression ratio internal combustion engine actuator apparatus as claimed in claim 5, wherein the filter mount surface is inclined in a direction toward a condition in which the filter mount surface is perpendicular to a direction of vibration at the oil filter mount part about a center of rotation of a crankshaft.

7. A variable compression ratio internal combustion engine actuator apparatus for an internal combustion engine including a variable compression ratio mechanism, wherein the variable compression ratio mechanism includes a control shaft, and an actuator configured to rotate the control shaft, and is configured to vary a mechanical compression ratio depending on rotational position of the control shaft, the variable compression ratio internal combustion engine actuator apparatus comprising:

a housing attached to a side wall of an engine body, and configured to support the actuator and accommodate an auxiliary shaft whose rotational position is configured to be controlled by the actuator;

a link mechanism configured to link the control shaft with the auxiliary shaft, wherein the control shaft is disposed inside of the engine body;

an oil filter mount part formed as a part of the housing; and a stopper part formed integrally with the oil filter mount part, and configured to define a first bound of rotational position of the auxiliary shaft;

wherein the housing further includes an oil cooler mount part above the oil filter mount part;

wherein the stopper part is above the oil filter mount part and below the oil cooler mount part;

wherein the variable compression ratio mechanism and the link mechanism are configured such that a maximum load applied to the control shaft is directed to outside of the housing;

wherein the oil filter mount part and the oil cooler mount part are formed integrally with an outside wall of the housing; and wherein the outside wall is formed with an oil passage extending vertically, wherein the oil passage is configured to allow communication between an oil filter and an oil cooler.

8. The variable compression ratio internal combustion engine actuator apparatus as claimed in claim 7, wherein the filter mount surface is inclined in a direction toward a condition in which the filter mount surface is perpendicular to a direction of vibration at the oil filter mount part about a center of rotation of a crankshaft.

* * * * *